United States Patent [19]

Gurries

[11] 4,420,963

[45] Dec. 20, 1983

[54] IMPACT RAIL FORGER

[75] Inventor: Raymond A. Gurries, Reno, Nev.

[73] Assignee: Resonant Technology Company, Sparks, Nev.

[21] Appl. No.: 328,163

[22] Filed: Dec. 7, 1981

[51] Int. Cl.[3] ..... B21J 7/20

[52] U.S. Cl. ..... 72/407; 72/429; 72/450

[58] Field of Search ..... 72/429, 407, 402, 450, 72/399, 406; 100/265, 264, 233

[56] References Cited

U.S. PATENT DOCUMENTS

| | | | |
|---|---|---|---|
| 779,663 | 1/1905 | Nelson | 72/407 |
| 3,597,958 | 8/1971 | Gross | 72/407 |
| 4,019,358 | 4/1977 | Frohling | 72/407 |

FOREIGN PATENT DOCUMENTS

| | | | |
|---|---|---|---|
| 770205 | 3/1957 | United Kingdom | 72/407 |

*Primary Examiner*—Gene P. Crosby

*Attorney, Agent, or Firm*—Townsend and Townsend

[57] ABSTRACT

A rail forger for reforming worn rails is disclosed. The forger includes a mobile frame capable of travel along the railway and a pair of forging shoes pivotally suspended from the frame. The forging shoes are adapted to travel along either side of the rail and are shaped to conform to the desired rail profile. By periodically and simultaneously applying a force to each forging shoe, the rail is impact forged and returned to its desired profile. A resonant system comprising a pair of horizontally suspended resonant beams is excited by a pair of eccentric weights at the upper ends of the beams to drive the associated forging shoes at the lower ends of the beams against the rail.

16 Claims, 6 Drawing Figures

IMPACT RAIL FORGER

BACKGROUND OF THE INVENTION

1. Field of the Invention

The present invention relates generally to impact forging, and more particularly to an apparatus for impact forging deformed steel rails used in railways to restore their original profile.

2. Description of the Prior Art

Steel rails used in railways degrade as they are exposed to large compressive forces imparted by the wheels of the railroad trains they support. Over time, the contact between the wheel of the railroad vehicle and the crown of the railroad track causes a lateral flange to develop along the inboard edge. The steel in the rail is extruded from the crown surface into a clearance gap between the inboard edge of the rail and the adjacent surfaces of the car wheels.

Typically, after the inboard edge of the rail has been deformed to the maximum extent tolerable, the rails on either side of the track are switched so that the outboard portion of the right rail becomes the inboard portion of the left rail. After a time, the newly exposed edge of the rail also becomes deformed beyond the acceptable level and it becomes necessary to reform or replace the individual rails.

Heretofore, reforming has been accomplished by cutting or grinding off the flange to impart the proper profile on the rail. While such reforming is workable, it suffers from several disadvantages in that it is expensive, time-consuming and wasteful of the steel in the rail. Moreover, the procedure may be repeated only a limited number of times before so much material has been lost that the rail becomes structurally inadequate and must be replaced.

SUMMARY OF THE INVENTION

The present invention is an impact forger capable of reforming an elongate object, such as a degraded railroad rail, while the object remains in place. The apparatus comprises a pair of forging shoes suspended from a mobile frame capable of traveling along the object, e.g. a railway. Each forging shoe travels along one side of the object and a means is provided for simultaneously applying very large force impules to each of the shoes so that the shoes strike opposite sides of the object at substantially the same time. The surface of the shoe which strikes the object is shaped so that it will impart the proper profile to the object through impact forging. In the case of a railway rail, the shoe includes a horizontal face for striking the flange formed on the rail and a substantially vertical face to provide a substantially rectilinear profile after the rail has been reforged.

It is preferred to use a resonant system to drive the forging shoes. Such a system would typically include a pair of resonant beams suspended from their upper nodes from the frame so that the lower anti-nodes lie within striking distance of the forging shoes. By exciting the beams synchronously, but 180° out-of-phase, the lower anti-nodes will simultaneously reciprocate inward (and outward) to repeatedly strike the forging shoes with sufficient force to reform the rail by impact forging.

Since the resonant beams are supported at their nodes, the oscillatory forces exciting the beams will not be transmitted to the frame. Moreover, the reaction force resulting from the impact of each anti-node on the associated forging shoe is balanced by an equal but opposite force experienced by the other anti-node since the beams are driven in an opposed manner, that is, 180° out-of-phase. As used in the remainder of this application, the phrase "synchronously but 180° out-of-phase" shall refer to the desired motion of the beams, where the lower anti-nodes move at the same frequency, but in the opposite direction, at all times.

A restraining frame is typically provided, substantially at the lower nodes of the beams to prevent the beams from moving outward as a result of the opposed reaction forces generated as the forging shoes strike the rail. This restraining frame is capable of absorbing substantially all of such reaction forces. In the preferred embodiment, the restraining frame is pivotally suspended from the main frame and only a small amount of vibration is transmitted to the frame. Thus, the main frame will experience little vibration and problems associated with stress and fatigue will be avoided.

In the preferred embodiment, a pair of substantially similar resonant beams are mounted at their upper nodes from an upper end of an elongate frame. A pair of oscillatory drivers, typically mounted at the upper end of each resonant beam at a point coincident with the beam's anti-node are driven synchronously, but 180° out-of-phase, to induce a standing lateral wave in each beam. The anti-nodes at the lower ends of the beams are each provided with a hammer which increases the force of impact on the rail. By striking the associated forging shoes with the hammer, successive compressive forces are applied to the rail to eliminate the undesirable flange characteristic of long use.

The restraining frame will typically comprise a pair of back-bars disposed adjacent the outer face of each beam substantially at the lower node thereof. By connecting the back-up bars with two hydraulic cylinders, the restraining frame is able to adjust the distance between the lower anti-nodes to precisely control the force applied to the rail. Additionally, the hydraulic system for the cylinders may be adapted to absorb shock created by the impact of the jaws on the rail.

The novel features which are characteristic of the invention as to organization and method of operation, together with further objects and advantages thereof, will be better understood from the following description considered in connection with the accompanying drawings, in which a preferred embodiment of the invention is illustrated by way of example. It is to be expressly understood, however, that the description and the drawings are for the purposes of illustration only and are not intended as a definition of the limits of the invention.

DESCRIPTION OF THE PREFERRED EMBODIMENT

Figure 2:
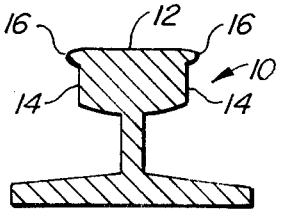
FIG. 2 is a cross-sectional view of a worn rail in need of reshaping.

Referring to FIG. 2, the profile of a railroad rail 10 may be observed. The rail includes a crown surface 12 at its top and a pair of vertical surfaces 14 at either side. The weight of a railroad train on the rail 10 provides a large, downward force which causes steel in the crown 12 to extrude outward, eventually forming a flange 16 on the side of the rail which bears the load. After the rails on either side of the track are interchanged, as is common practice, and the other side of the rail 10 is subjected to the load, a flange 16 will form on the other side and the cross-section of the rail will appear as shown in FIG. 2.

Figure 1:
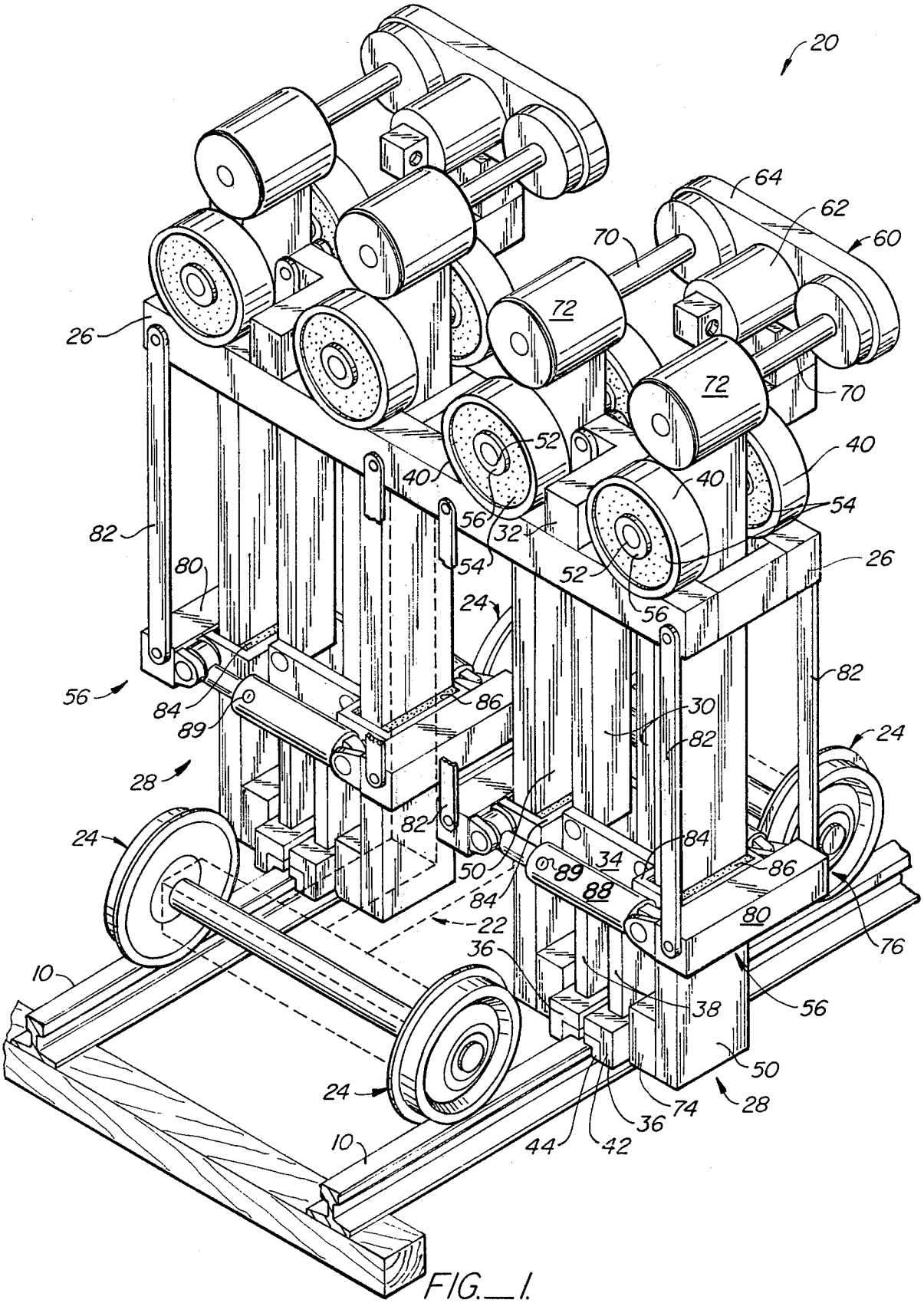
FIG. 1 is a perspective view of the impact forger of the present invention.

Referring now to FIG. 1, the impact forger 20 of the present invention includes an elongate vertical frame 22 (portions of which are shown in phantom) which is adapted to ride on rail wheels 24. The frame 22 may be self-powered or, more typically, it will be drawn by a separate powered rail vehicle. The forger is designed to reform the rails in a single pass, although portions of the rail which are particularly deformed may be subjected to multiple passes.

A horizontal support frame 26 is generally rectangularly shaped and mounted at the top of the vertical frame 22. The horizontal frame extends outward from the vertical frame, substantially covering the distance between the parallel rails 10 which form the railway.

A pair of resonant impact systems 28 are suspended from the horizontal support frame 26, one on either side of the central vertical frame 22. The construction of each of the resonant impact systems 28 is identical and the components thereof will only be described once in reference to the system 28 shown on the right, as viewed in FIG. 1. It will be understood that such description applies equally well to the resonant system 28 shown at the left of FIG. 1.

Figure 3:
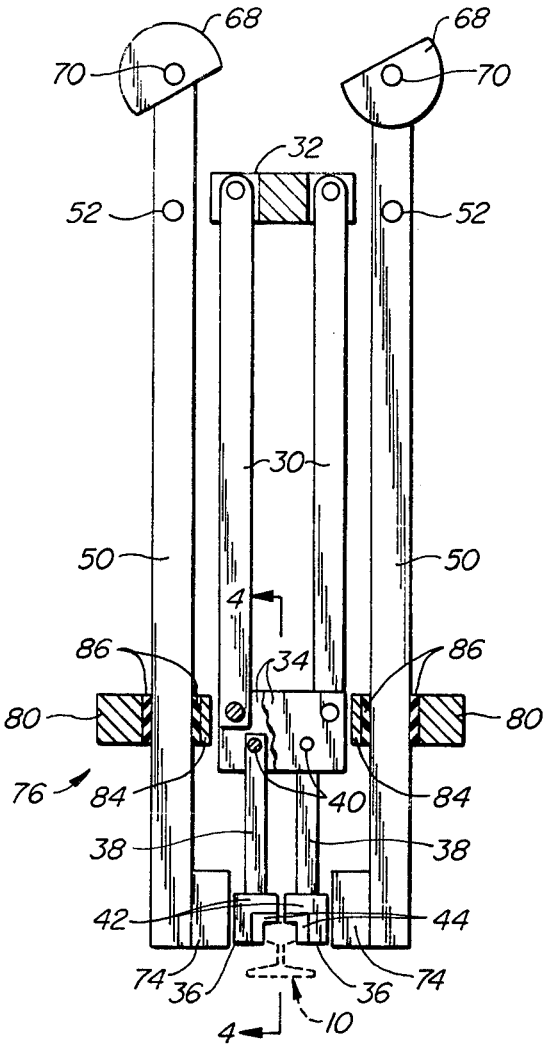
FIG. 3 is an elevational view of the resonant system of the present invention.

Referring now to FIGS. 1 and 3, the construction of the resonant impact system 28 will be described in detail. A pair of vertical support arms 30 are each pivotally suspended from one side of a T-shaped bracket 32 secured to the horizontal support frame 26 at a position substantially above the right-hand rail 10. A first plate 34 is pivotally attached to the forward, lower ends of both support arms 30 to form a parallelogram frame such that the plate 34 remains aligned parallel to the bracket 32 at all times. A second plate 34 (visible only in FIG. 4) is similarly secured to the rear of the lower ends of the support arms 30. A pair of arms 38 are pivotally secured between plates 34 and extend doward so that their lower ends lie adjacent the rail 10. A forging shoe 36 is mounted at the lower end of each arm 38 so that one forging shoe lies on each side of the rail 10.

Thus, the forging shoes 36 are free to reciprocate toward one another about a radius extending from their attachment points 40 (FIG. 3) to the outer ends thereof. Additionally, both of the forging shoes 36 are able to move in unison as a result of plates 34 swinging on arms 30. This latter motion allows the forging shoes to align themselves properly with the rail 10, while the motion about pivots 40 allows the shoes to strike the rails under the force of the resonant beams, as described hereinafter.

Figure 4:
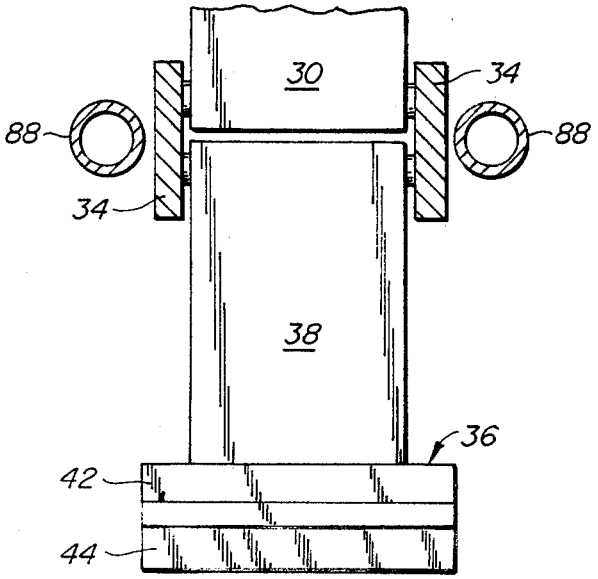
FIG. 4 is a detailed view of the forging shoe of the present invention.

Referring now also to FIG. 4, the forging shoe 36 is typically a length of steel having an L-shaped cross section. The shoe 36 comprises two pieces, an outer member 42 which is directly attached to the lower end of arm 38 and an inner member 44, which directly contacts the rail upon reciprocation of the forging shoe. The inner member 44 is typically formed from a particularly hard alloy of steel, such as stellite or the like, and can be replaced when worn.

The resonant impact system 28 further comprises a pair of resonant beams 50 which are each suspended on a shaft 52 inserted through a hole generally aligned with the upper node thereof. Each end of the shaft 52 is received in a shock-absorbing mount 40 (FIG. 1) adapted to isolate the resonant beam 50 from the frame. The shock absorbing mounts 40 each include an inner bearing (not shown) surrounded by resilient material 54, typically a solid rubber tire or the like. A retaining ring 56 secured at each end holds the shaft 52 in place. The four shock-absorbing mounts 40 associated with each of the resonant systems 28 are each supported on the top of the horizontal support frame 26 on either side of the bracket 32.

An oscillatory driver 60 is adapted to impart reciprocating lateral forces to each of the resonant beams 50 so as to induce a standing lateral wave therein. The lateral forces required may be applied at either the upper or middle anti-node, although it is more convenient to mount the driver 60 at the upper ends of the beams 50, as illustrated herein. The oscillatory driver 60 includes a motor 62 (FIG. 1), typically a hydraulic motor, a gear box 64 which simultaneously rotates a pair of double universal joints at the same speed but in opposite directions and one or more eccentric weights 68 (FIG. 3) which are mounted on shafts 70 coupled directly to the universal joints and housed in a covering 72 formed in the upper end of the beams 50. The operation of the eccentric weights 68 will be described in detail hereinafter.

A hammer 74 (FIGS. 1 and 3) is secured at the lower anti-node of each of the resonant beams 50 and lies adjacent, spaced a short distance apart from the rear vertical surface of the associated forging shoe 36. When the driver 60 is at rest, a short gap will exist between the hammer 74 and the forging shoe 36. The hammer 74 should be formed from a material able to withstand the constant pounding to which it will be subjected.

As stated hereinabove, the resonant beams 50 are pivotally supported at their upper nodes on shafts 52 and are not secured to the frame at any other point. A restraining frame 76 engages the matched pairs of resonant beams 50 substantially at their lower nodes to limit the outward motion of each resonant beam resulting from the reaction force generated in striking the associated forging shoe 36. The restraining frame 76 comprises a pair of back-up bars 80 which are attached to the lower ends of swing arms 82 pivotally suspended at their upper ends from the horizontal support frame 26. A bracket 84 is provided on the interior face of each back-up bar 80 and completes the enclosure of the associated resonant beam 50. A resilient pad 86 is provided on the interior face of the back-up bar as well as on the interior face of the bracket 84 to absorb reactive forces generated as the hammer 74 strikes the forging shoe 36.

The back-up bars 80 are connected by a pair of hydraulic cylinders 88 (FIG. 1) which may be adjusted to vary the distance between the forging shoes 36. Each cylinder 88 is double-acting and connected to a hydraulic system (not shown) which actuates the cylinders to their desired position. In addition to providing the operative means for opening and closing the hammers 74, the hydraulic system may include accumulators, or other surge capacity, so that cylinders 88 will yield to reactive forces generated during operation which are greater than anticipated. Alternatively, the cylinders 88 or the hydraulic system may be provided with pressure relief valves 89 which will allow the system to yield to such larger-than-expected forces.

The cylinders 88 should be sized so that they will yield to the maximum expected reaction force. Thus, should the forging shoes 36 encounter some unexpected object which drives them outward, the impact of the hammers 74 on the anvils 36 will merely cause the lower ends of the beams 50 to further separate. If the beams 50 were held firmly at their lower nodes, the forging shoes 36 might become immovably lodged against the hammers, causing the beams to enter a forced vibration mode which could damage the apparatus.

Figure 5A:
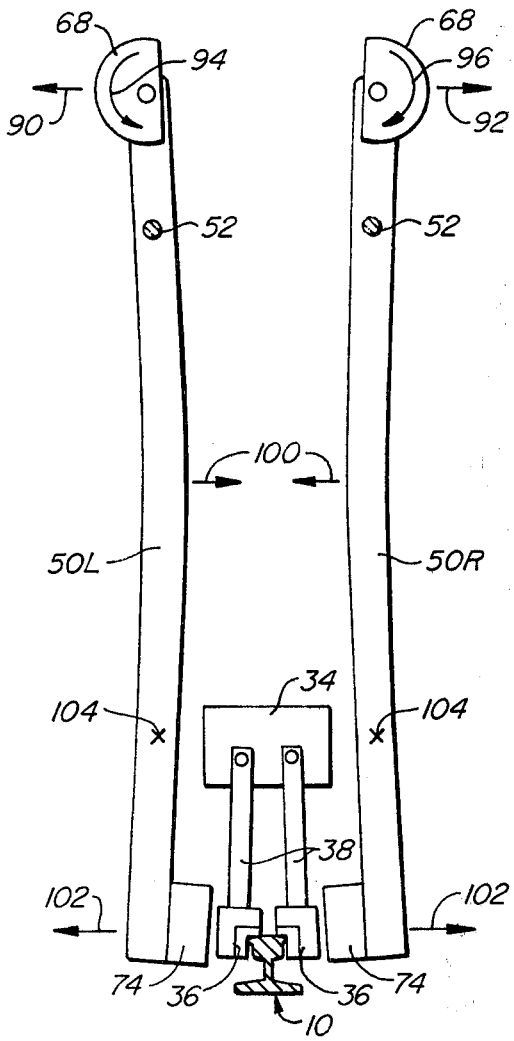
FIGS. 5A and 5B are schematic views of the resonant beams illustrating the movement induced by the oscillatory drivers.
Figure 5B:
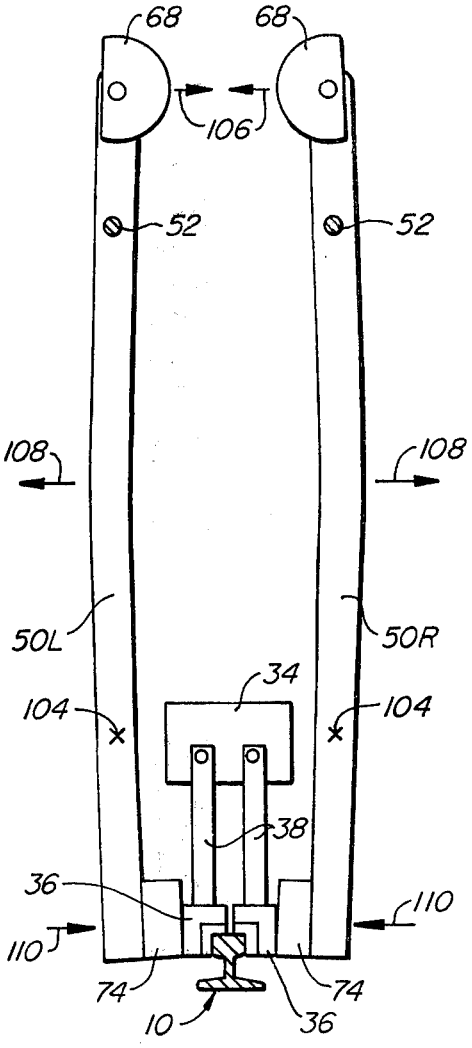

Referring now to FIGS. 5A and 5B, the resonant characteristics of the beam 50 will be explained. The beams 50 depend vertically from the shafts 52 and are otherwise unsupported. The shaft 52 is journalled through the upper end of each beam 50 and has one or more eccentric weights 68 mounted thereon (as described hereinabove). The weights are driven synchronously, but 180° out-of-phase, by the oscillatory driver 60. Thus, each weight 68 is exerting a rotating radially outward force.

Referring particularly to FIG. 5A, the weight 68 at the top of the left-hand beam (referred to as 50L in FIGS. 5A and 5B) would be exerting a lateral force in the direction of arrow 90 while the weight 68 at the top of the right hand beam (50R) would be exerting a force in the opposite direction, as indicated by arrow 92. While the weights may be driven in either direction, for the purposes of illustration, the weight 68 on beam 50L is shown to rotate counterclockwise as indicated by arrow 94, while the weight 68 at the top of beam 50R is shown to rotate clockwise, as indicated by arrow 96. Thus, FIG. 5A illustrates the weights at the moment they are exerting the maximum outward lateral forces on beams 50L and 50R. The maximum lateral displacement at the upper anti-nodes will follow a short time later, due to the inertia of the beams.

In FIG. 5B, the weights 68 at the top of the beams 50L, 50R are illustrated at the moment they are exerting their maximum inward force on the beams. Again, the maximum inward displacement of the upper antinodes will occur a short time after the maximum force has been imparted.

As the inward and outward forces applied to the upper anti-nodes of the beams 50 alternate, a lateral standing wave is induced in each beam. In FIG. 5A, as the upper anti-node is moving outward, the middle anti-node is moving inward as illustrated by arrows 100. Similarly, the lower anti-nodes are moving outward as illustrated by arrows 102. The upper node (coincident with shaft 52) and the lower node (at 104), of course, remain substantially stationary.

Referring now to FIG. 5B, as the upper anti-nodes move inward (arrows 106), the middle anti-nodes move outward (arrows 108) and the lower anti-nodes move inward (arrows 110). This "S"-shaped wave pattern is repeated at the frequency induced by the oscillatory driver 60. Typically, the system will be driven at a frequency slightly below the resonant frequency to avoid overdriving the system.

In operation, the impact forger 20 will be drawn along the worn rails by a locomotive or other driving means. The oscillatory driver will be continuously driven and the resonant beams 50 will cause the anvil 74 to repeatedly strike the forging shoes 36 on their rear surface (surface opposite the rail). The energy imparted to the rail will cause the flange 16 on the rail 10 to heat up and the force exerted will cause the flange to recede back into the rail. The L-shape of the forging shoes 36 will cause the rail to reassume its proper profile.

While the preferred embodiment is illustrated in detail it is apparent that modifications and adaptations of that embodiment will occur to those skilled in the art. However, it is to be expressly understood that such modifications and adaptations are within the spirit and scope of the present invention, as set forth in the following claims.

What is claimed is:

1. An apparatus for impact forging an elongate object such as a rail, said apparatus comprising:

a mobile frame that is capable of travelling along the object in place;

first and second forging shoes located so that the first shoe lies on one side of the object and the second shoe lies on the opposite of the object;

first and second resonant beams having anti-nodes at each end and at least one node spaced inward from the end, said beams being suspended from the frame from a location on the beam substantially coincident with the uppermost node so that the lower anti-nodes of the beams are located on the outer sides of the respective forging shoes; and means for inducing a lateral wave in each of the beams at or near its resonant frequency whereby the beams drive the forging shoes in phase against the opposite sides of the rail.

2. An apparatus as in claim 1, and additionally comprising means for engaging the beams substantially at their lower nodes and for restraining the outward movement of the beams in response to the reaction force of the beams striking the forging shoes.

3. An apparatus as in claim 2, wherein said means for engaging the beams is suspended from the frame so that said means swing as the lower ends of the beams are laterally displaced.

4. An apparatus as in claim 2, wherein said means for engaging and restraining the beams further includes means for varying the distance between the beams.

5. An apparatus as in claim 1, wherein said means for inducing a lateral wave is an eccentric weight oscillator mounted substantially at the upper anti-node of each beam.

6. An apparatus as in claim 1, wherein said first and second forging shoes each include a pair of substantially perpendicular faces which define the desired profile of a rail.

7. An apparatus as in claim 1 wherein the forging shoes are suspended from the frame so that said forging shoes are struck by the lower end of the beams and driven against the opposite sides of the rail.

8. An apparatus for impact forging a pair of parallel rails which form a railway, said apparatus comprising:

a mobile frame that is capable of travelling along a railway having a pair of rails;

two resonant impact systems mounted on the frame, each system located to engage one of the rails and comprising:

(a) first and second forging shoes pivotally suspended from the frame and lying generally on opposite sides of the associated rail;

(b) first and second resonant beams suspended from the frame, each of said beams having upper and lower anti-nodes located substantially at the upper and lower ends thereof and a central anti-node, and upper and lower nodes intermediate the anti-nodes, the beams being suspended from the upper nodes so that the lower anti-nodes lie adjacent the respective forging shoes;

(c) means for resonantly exciting the beams at or near their resonant frequency to cause the beams to strike the forging shoes and drive them against the rail; and (d) means for engaging the lower nodes of the beams and restraining them to counteract the reaction forces on the beams as they strike the forging shoes.

9. An apparatus as in claim 8, wherein said means for engaging the lower nodes of the beams and restraining them includes a pair of back-up bars, each back-up bar swingably suspended from the frame and disposed adjacent one of the resonant beams, said back-up bars being secured to one another to restrain the outward movement of the beams.

10. An apparatus as in claim 9, wherein said back-up bars are secured to one another by one or more hydraulic cylinders so that the distance therebetween may be adjusted.

11. An apparatus as in claim 10, wherein said hydraulic cylinders include means for relieving excess hydraulic pressure generated when the reaction force of the forging shoes striking the rail exceeds a predetermined limit.

12. An apparatus as in claim 8, wherein said first and second forging shoes each include a pair of substantially perpendicular faces which define the desired profile of the rail.

13. An apparatus as in claim 8, wherein the means for resonantly exciting the beams comprises an eccentric weight oscillator mounted at the upper anti-node of each beam and means for rotating the oscillators in a predetermined phased relationship.

14. A resonantly-driven apparatus for impact forging an object, said apparatus comprising:

a frame;

first and second forging shoes pivotally suspended from the frame so that said shoes are free to reciprocate inward toward each other;

a pair of resonant beams having anti-nodes at each end and at least one node spaced inward from the ends and having substantially the same dimensions and resonant characteristics, both of the beams being suspended from the frame from a location on the beam substantially coincident with the uppermost node so that the lower anti-node of the beam lies within striking distance of one of the forging shoes; and means for inducing a lateral wave in each of the beams at or near its resonant frequency whereby the beams repeatedly and simultaneously strike the forging shoes and cause the forging shoes to impact forge the object held therebetween.

15. An apparatus as in claim 14, further comprising means for engaging the beams substantially at their lower nodes and for restraining the outward movement of the beams in response to the reaction force of the forging shoes striking the object.

16. An apparatus as in claim 14, wherein the means for inducing a lateral wave is an eccentric weight oscillator mounted substantially at the upper anti-node of each beam.

* * * * *